United States Patent [19]

Shannon

[11] Patent Number: 4,624,391

[45] Date of Patent: Nov. 25, 1986

[54] AUTOMATIC WINE DISPENSER

[75] Inventor: Joseph W. Shannon, Kent, Ohio

[73] Assignee: American Business Computers, Mogadore, Ohio

[21] Appl. No.: 543,877

[22] Filed: Oct. 20, 1983

[51] Int. Cl.[4] ..... B65B 55/00

[52] U.S. Cl. ..... 222/53; 222/129; 222/152; 222/190; 222/373; 222/397; 222/399; 99/323.1; 426/330.4

[58] Field of Search ..... 222/53, 152, 190, 372, 222/373, 394, 396, 397, 399, 56, 61, 641, 130, 129, 129.1, 129.2, 129.3, 129.4, 136, 3; 422/1; 99/323.1, 323.2, 275–278; 426/397, 592, 330.4; 53/432, 510; 141/11, 69, 70

[56] References Cited

U.S. PATENT DOCUMENTS

| | | | |
|---|---|---|---|
| 2,028,302 | 1/1936 | Thomson | 222/61 |
| 2,371,431 | 3/1945 | Pietro | 99/323.2 |
| 3,281,014 | 10/1966 | Nickerson | 222/190 X |
| 3,991,911 | 11/1976 | Shannon et al. | 222/129.4 X |
| 4,143,793 | 3/1979 | McMillin et al. | 222/61 X |
| 4,392,578 | 7/1983 | Fipp et al. | 222/152 X |
| 4,473,174 | 9/1984 | Heuser | 222/152 |
| 4,477,477 | 10/1984 | Arter | 99/275 X |

*Primary Examiner*—Joseph J. Rolla

*Assistant Examiner*—Kevin P. Shaver

*Attorney, Agent, or Firm*—Oldham, Oldham & Weber Co.

[57] ABSTRACT

An automatic dispenser for wine has a first reservoir which holds an inverted bottle of wine and a second reservoir connected to the first reservoir through a check valve for holding a supply of wine received from the first reservoir. A solenoid actuated valve is interposed in a wine dispense line connected to the second reservoir. A source of pressurized nitrogen gas is connected to both the first and second reservoirs for supplying the discharge pressure for dispensing the wine from the second reservoir upon actuation of the solenoid, and for maintaining a nitrogen enriched atmosphere in contact with the wine at all times in the reservoirs to prevent secondary fermentation of the wine in the reservoirs by the oxygen in the air. Nitrogen is supplied automatically to the first reservoir through a demand control valve each time wine is removed from the second reservoir to occupy the space vacated by the dispensed wine. Also, manual actuation of a purge valve will supply nitrogen to the first reservoir to force most of the air therefrom and to fill any void space with nitrogen upon opening the first reservoir to the atmosphere upon placing a new bottle of wine on the first reservoir.

8 Claims, 2 Drawing Figures

AUTOMATIC WINE DISPENSER

TECHNICAL FIELD

The invention relates to beverage dispensers and in particular to automatic beverage dispensers for wine. More particularly, the invention relates to an automatic wine dispenser which maintains the wine in a nitrogen enriched atmosphere to prevent secondary fermentation of the wine by oxygen present in air when the wine is in the dispensing system prior to being dispensed for consumption.

BACKGROUND ART

Automatic beverage dispensers have increased in popularity and are finding a variety of uses in restaurants and lounges for automatically dispensing beverages. In particular, these dispensers are used for dispensing alcoholic beverages and the ingredients for making a mixed drink, highball, cocktail or the like. One such automatic dispenser of which the present invention is a modification and improvement thereon, is shown in my earlier U.S. Pat. No. 3,991,911. Although this dispenser has proved highly satisfactory for dispensing of most alcoholic beverages and mixes therefor, problems occur when the dispenser is used for dispensing of wines.

Wine, especially when originating from a bottle, upon exposure to air will go into secondary fermentation due to the oxygen content of the air. This secondary fermentation will ruin the taste and color of the wine if the wine is exposed to the air for any appreciable length of time prior to being served and consumed. Wine is usually supplied to restaurants and lounges in bottles, and it is illegal in certain states to transfer the wine into other containers prior to serving in order to eliminate this secondary fermentation problem upon opening of the bottle.

Therefore, the use of automatic beverage dispensers has been difficult to adapt for use in dispensing of wines, although the same is preferred due to the ease and accuracy of dispensing, as well as the associated cost controls and accounting features and other advantages provided thereby as set forth in U.S. Pat. No. 3,991,911.

Consequently, the need has existed for an automatic wine dispenser of a type similar to that used for dispensing of alcoholic beverages and mixes therefor which eliminates this secondary fermentation problem.

DISCLOSURE OF THE INVENTION

Objectives of the invention include providing an improved automatic wine dispenser which eliminates secondary fermentation of the wine when contained in the dispenser by preventing oxidation of the wine by maintaining the wine in a nitrogen enriched atmosphere. Another objective of the invention is to provide such a wine dispenser which enables the wine to be dispensed from their original containers or bottles thereby enabling the owner of the restaurant or lounge establishment to conform with various state and local laws.

A still further objective of the invention is to provide such a wine dispenser which can be easily incorporated into existing alcoholic beverage dispensers and in which such prior dispensers can be used for the dispensing of wine by relatively minor, yet unique modifications thereto, facilitating their manufacturing, assembling and usage thereof.

Another objective of the invention is to provide such a dispenser in which any air that is trapped in the wine storage reservoir of the dispensing system can be purged easily therefrom by manual actuation of a purge valve which supplies a sufficient quantity of nitrogen gas under a slight pressure to the reservoir to force the air out through a purge valve; and in which such a feature is desirable to replace the air in the reservoir when an empty bottle of wine is replaced in the reservoir with a filled bottle. Another objective is to provide such a wine dispenser having a demand regulator which automatically compensates for removal of wine from the storage reservoir by filling the vacated space in the reservoir and in the wine bottle with nitrogen upon the dispensing of a quantity of wine from the reservoir and bottle, thereby maintaining the nitrogen enriched atmosphere in the reservoir and wine bottle at all times.

Another objective of the invention is to provide such a dispenser in which the supply of nitrogen used to maintain the nitrogen enriched atmosphere in the storage reservoir, also may be used to supply the pressure for discharging the wine from a second reservoir through a flow line to a drink dispenser when a dispensing solenoid in the flow line is actuated by the bartender or waitress; and in which this discharge nitrogen gas further reduces secondary fermentation from occurring in the wine. Another objective is to provide such a dispenser in which the wine is maintained in a nitrogen enriched atmosphere which is at atmospheric pressure except when discharging the wine to prevent the nitrogen from being absorbed into the wine and affecting its appearance and taste.

These objectives and advantages are obtained by the improved automatic wine dispenser, the general nature of which may be stated as including a first reservoir for containing a quantity of wine, a supply of pressurized nitrogen gas; a second reservoir in communication with the first reservoir through a first valve at a first end of said second reservoir, and with said second reservoir being in communication with the supply of nitrogen gas through a second valve at a second end thereof; a wine dispensing line connected to the second reservoir and having flow valve means interposed therein for controlling the flow of wine being dispensed from said second reservoir through said line; vent means communicating with the first reservoir for venting any air trapped within said first reservoir; control means communicating with the supply of nitrogen gas and with the first reservoir for maintaining a predetermined amount of nitrogen gas in said first reservoir and for purging any air contained therein; and valve control means for controlling the second valve for supplying pressurized nitrogen gas to the second reservoir for the dispensing of wine therefrom.

BRIEF DESCRIPTION OF THE DRAWING

Similar numerals refer to similar parts throughout the drawing.

BEST MODE FOR CARRYING OUT THE INVENTION

Figures 1, 2:
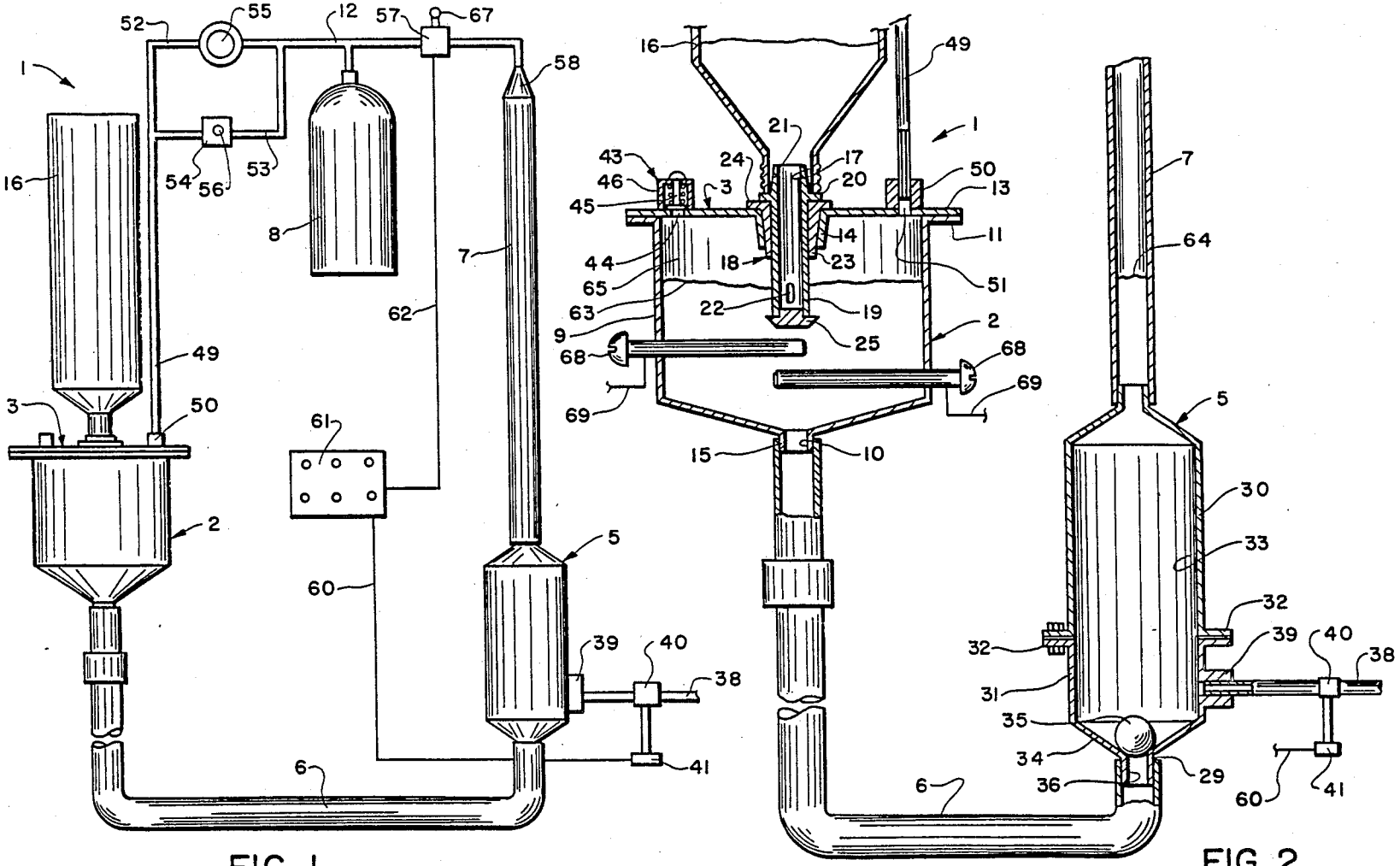
FIG. 1 is a diagrammatic block diagram of the improved wine dispenser.
FIG. 2 is a fragmentary cross-sectional view of some of the main components of the wine dispenser.

The improved wine dispenser is indicated generally at 1, and is shown diagrammatically in FIG. 1. Dispenser 1 includes a generally airtight filling reservoir indicated generally at 2, with a bottle adapter 3 mounted on the upper end thereof. A dispensing pump indicated generally at 5, is connected to filling reservoir 2 by a tube or conduit 6. Dispensing pump 5 is connected at its upper end by a tube 7 to a supply of pressurized nitrogen gas which is contained in a cylinder 8 through a gas feed line 12.

Filling reservoir 2 (FIG. 2) includes a generally tubular container 9 preferably formed of non toxic plastic or stainless steel having a reduced bottom neck 15 which defines opening 10 and an annular flange 11 formed at the top end. Neck 15 is received in liquid and airtight relationship with tube 6. Top flange 11 functions as a support for bottle adapter 3. Bottle adapter 3 includes a circular disc 13 having an angularly depending circular boss 14 that is located in the center of disc 13 for self-locating purposes. A usual bottle 16 of wine has a discharge member which is indicated generally at 18, mounted in open end 17 thereof when mounting bottle 16 on reservoir 2. Member 18 consists of a sleeve 19 having a flange 20 and a tapered end portion 21 that is snugly received in self-centered relationship in open end 17 of bottle 16. Diametrically spaced openings 22 are provided in the outer end of tube 19 for dispensing wine from bottle 16 when the bottle is in an inverted position mounted on bottle adapter 3 as shown in FIG. 2.

A tapered locating sleeve 23 having a flange 24 is telescoped around the exterior of sleeve 19 and is positioned in disc boss 14 between flange 20 and disc 13. The tapered surface of sleeve 23 preferably is conical in nature and complementary to the interior surface of disc boss 14 to provide an airtight fit therebetween. A cap 25 is fixed in the outer open end of tube 19 and together with sleeve 23 forms a closure for tube 19 when discharge member 18 is initially inserted into bottle end 17 prior to inverting bottle 16 in disc boss 14 as explained in greater detail in U.S. Pat. No. 3,991,911.

A low level indicator provided by a pair of sensor electrodes 68 may be mounted on reservoir 2 and connected to a multiplexing circuit of the type shown in U.S. Pat. No. 4,213,339 by wire 69 to provide a signal that the wine level in reservoir 2 has reached a position requiring a new bottle of wine to be mounted thereon. The other end of conduit 6 is connected with a liquid and airtight connection to a reduced annular neck 29 formed at the lower end of a dispenser pump 5. Dispensing pump 5 preferably is a two-piece member formed by upper and lower sections 30 and 31 joined by mating flanges 32 to form a second airtight fluid reservoir 33. Flange 29 is formed at the lower end of section 31 which terminates in a tapered bottom wall 34 and defines bottom opening 36.

A stainless steel ball 35 is located within reservoir 33 and gravitationally seals opening 36.

A wine dispensing line 38 is mounted in a boss 39 that is formed on the side wall of lower section 31 of reservoir 33 and communicates with the interior thereof. A solenoid controlled valve 40 is interposed in dispensing line 38 and may be controlled by a diode 41 connected thereto for accurately controlling the amount of wine that is discharged from dispensing pump 5 through line 38 upon actuation of the proper control therefor.

In accordance with one of the features of the invention, a vent or pressure control valve 43 is mounted on disc 13 and communicates with the interior of filling reservoir 2 through an opening 44 formed in disc 13. Valve 43 may be of the type shown in FIG. 2 consisting of a sealing rod 45 which is biased into a normally closed position by a coil spring 46. Other valve arrangements may be used without affecting the concept of the invention. Coil spring 46 exerts a relatively small amount of pressure on plunger rod 45, sufficient to maintain it in a closed sealing position with disc opening 44 as shown in FIG. 2, while requiring only a relatively small amount of pressure to be exerted thereon by gas injected into reservoir 2 to open the valve for venting gas and trapped air to the surrounding atmosphere.

A gas supply tube 49 is mounted in a boss 50 formed on disc 13 and communicates with the interior of reservoir 2 through a disc opening 51 defined by boss 50. Gas supply tube 49 communicates with nitrogen cylinder 8 through a pair of branch lines 52 and 53. A valve 54 is interposed in branch line 53 and a demand regulator 55 is interposed in branch line 52. Valve 54 may be controlled either by button 56 or by a remote controlled solenoid. A solenoid controlled valve 57 is mounted in gas line 12 which extends between nitrogen cylinder 8 and upper end 58 of tube 7. Valve 57 is electrically connected to a central operator controlled keyboard 61 or other control means by a line 62. Wine dispensing control solenoid also is connected to keyboard 61 by another electric line 60.

The operation of improved wine dispenser 1 is similar in many respects to the beverage dispenser described in detail in U.S. Pat. No. 3,991,911. A bottle of wine 16 is opened and discharge member 18 inserted in the open end 17 thereof. The bottle is inverted and placed in reservoir disc boss 14 which forms an airtight seal therebetween. This chamber is purged of air by actuation of purge valve 54 and then the wine will flow from the bottle through openings 22 of discharge sleeve 19, through conduit 6 and into reservoir 33 of dispensing pump 5 until the wine reaches a liquid level 63 in reservoir 2 which conforms with the level of discharge opening 22. Correspondingly, the wine will reach a level 64 in tube 7 of dispensing pump 5.

Actuation of valve 54, either manually by depressing a button 56 on the valve or by a remote controlled solenoid, will discharge a quantity of nitrogen from cylinder 8 through line 53 and tube 49 into an upper air space 65 located between wine level 63 and disc 13. This purging operation is done prior to depressing the bottle into fully open position in the reservoir. The incoming nitrogen will have sufficient pressure to open purge valve 43 whereupon all of the air which is trapped in space 65 upon placing a new bottle of wine on reservoir 2 will be vented to the surrounding atmosphere. Valve 54 is maintained open a sufficient length of time to ensure that a sufficient amount of nitrogen is discharged from cylinder 8 into space 65 to purge nearly all of the air therefrom forming a blanket of nitrogen in space 65.

A bartender to dispense a glass of wine will actuate the appropriate button on keyboard panel 61 or on a handheld dispensing nozzle which will generally simultaneously open valves 57 and 40. The pressurized nitrogen from cylinder 8 will flow through line 12 and tube 7 toward reservoir 33 forcing a quantity of wine in reservoir 33 through opened dispensing line 38 past solenoid 40 for a predetermined length of time to fill a wine glass. Wine dispensing line 38 is connected to a dispensing nozzle which may be fixedly mounted as on a dispenser unit at the bar or manually held and manipulated by the bartender.

During this dispensing operation ball 35 will seal lower opening 36 of reservoir 33 preventing any wine from flowing through conduit 6 toward reservoir 2. After the predetermined amount of wine has been dispensed through line 38, solenoids 57 and 40 will close. Valve 57 will be of a type that after being moved to a closed position to block further flow of the pressurized drink discharge nitrogen gas from cylinder 8, will have a nonpressure one-way check valve 67 as a part thereof which will permit the pressurized nitrogen gas remaining in tube 7 to be vented to the atmosphere to reduce the pressure of the nitrogen remaining in tube 7 to atmospheric pressure while preventing any air from entering tube 7. This enables the pressure exerted by the wine in reservoir 2 to lift ball 35 from its sealing engagement with annular flange 29, permitting the wine to be restored to its liquid level 64.

Demand regulator 55 will permit sufficient nitrogen to flow through line 52 and tube 49 to replace the discharged wine and maintain a nitrogen enriched atmosphere in space 65 of reservoir 2 above wine level 63. Nitrogen still remains in tube 7 at atmospheric pressure to prevent air from entering tube 7 thereby eliminating secondary fermentation. Likewise, the atmospheric pressure of the nitrogen in tube 7 as well as the nitrogen in space 65 of reservoir 2 will prevent it from readily mixing with the wine and affecting its taste which could occur if the nitrogen remained at a higher pressure.

Thus, in accordance with the main concept of the invention, the wine is always maintained in a nitrogen enriched atmosphere since space 65 of reservoir 2 is continually filled with nitrogen by demand regulator 55 after each dispensing operation. Likewise, the space in tube 7 above the wine will have nitrogen trapped therein from the nitrogen remaining from that used to dispense the wine. The remaining portions of the system will be filled with wine. The only time air will be introduced into the dispenser is when a new bottle of wine is placed on top of reservoir 2. As discussed above, immediately after placing the new bottle of wine on reservoir 2 and prior to fully depressing discharge member 18 into the reservoir by opening, purge valve 54 is actuated discharging the air trapped in space 65 into the atmosphere and filling the same with nitrogen. A new bottle of wine will usually be placed on top of reservoir 2 prior to the wine dropping below level indicator 28. This eliminates any air from entering conduit 6, reservoir 33 and pressure line 7.

Although the above nitrogen control system is shown using a plurality of valves 54 and 57 and demand regulator 55, these components can be replaced with other types of mechanisms for maintaining a supply of nitrogen in space 65 and tube 7. For example, two separate sources of nitrogen can be used, one source connected with reservoir 2 for maintaining a nitrogen blanket in space 65 with the second source of nitrogen supplying sufficient pressure to reservoir 33 to dispense the wine therefrom and for maintaining the upper portion of tube 7 blanketed with nitrogen at all times. Appropriate controls would be provided for relieving the pressure sufficiently to enable the wine to reach its fluid level without permitting air to be introduced into line 7 at any time. Likewise, a plurality of the improved wine dispensers 1 may be interconnected and controlled by a single source of nitrogen and from a single panel by appropriate interconnected control valves in a similar manner as shown in the beverage dispenser of U.S. Pat. No. 3,991,911 without affecting the concept of the invention. This would enable a variety of wines to be dispensed from a single control station located by a bartender. Also dispensing pump 5 having a reservoir 33 could be replaced with other types of fluid pumps that would draw the wine directly from reservoir 2.

Accordingly, improved wine dispenser 1 provides an automatic wine dispensing system which maintains the wine in a nitrogen enriched atmosphere to prevent secondary fermentation from occurring, and in which nitrogen is used to maintain the desired level of wine in the dispensing pump as well as for the dispensing pressure medium. Furthermore, another advantage of the improved wine dispenser is that the discharge pressure is low and the nitrogen supplied through demand regulator 52 and the pressure of the nitrogen in tube 7 is at atmospheric level to prevent it from appreciably mingling with the wine to affect its taste. Likewise, the dispenser enables the wine to be dispensed from its original containers or bottles in which it was supplied to the restaurant or lounge.

Accordingly, the improved wine dispenser is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved wine dispenser is constructed and used, the characteristics of the construction, and the advantageous, new and useful results obtained; the new and useful structures, devices, elements, arrangements, parts, and combinations, are set forth in the appended claims.

What is claimed is:

1. In a wine dispenser, an improvement including:

(a) first and second reservoirs connected by a flow conduit;

(b) a first valve for preventing reverse flow from said second reservoir to said first reservoir;

(c) bottle mounting means on the first reservoir for reeeiving an inverted bottle of wine for supplying a predetermined quantity of wine to the first and second reservoirs;

(d) a wine dispensing line connected to the second reservoir and having flow valve means interposed therein for controlling the flow of wine being dispensed from said second reservoir through said line;

(e) a vent valve communicating with the first reservoir for venting any air trapped within said first reservoir;

(f) a supply of pressurized nitrogen gas;

(g) gas line means connecting said first and second reservoirs and said supply of nitrogen gas, said gas line means including (1) first control means connected between the supply of nitrogen gas and the first reservoir for purging air from said first reservoir and for maintaining a nitrogen enriched atmosphere therein above the level of the wine, said first control means including a demand regulator which supplies a predetermined quantity of nitrogen gas to the first reservoir after each drink is dispensed from the second reservoir, a purge valve for supplying a sufficient quantity of nitrogen gas to the first reservoir to purge any air that is trapped in said first reservoir through the vent valve after placing a filled bottle of wine on said first reservoir, and said demand regulator and purge valve being connected in parallel; and (2) second control means connected between the supply for nitrogen gas and the second reservoir for supplying pressurized nitrogen gas to said second reservoir for dispensing of wine therefrom, and for maintaining a nitrogen enriched atmosphere is contact with the wine in the second reservoir.

2. The improved wine dispenser defined in claim 1 in which the vent valve is a pressure relief valve.

3. The improved wine dispenser defined in claim 1 in which the purge valve is manually actuated.

4. The improved wine dispenser defined in claim 1 in which the nitrogen enriched atmospheres which are in contact with the wine in the first and second reservoirs are at atmospheric pressure.

5. The improved wine dispenser defined in claim 1 in which said first reservoir has a first opening for receiving said supply of nitrogen gas under pressure and a second opening for providing communication with said bent valve.

6. The improved wine dispenser defined in claim 1 wherein said second control means includes a solenoid operated valve and wherein said flow valve means is solenoid operated, and means for simultaneously opening said flow valve means and the solenoid operated valve in said second control means.

7. The improved wine dispenser defined in claim 1 in which the second control means includes a valve disposed in said gas line means between the supply of nitrogen gas and second reservoir for admitting a supply of said pressurized nitrogen gas to the second reservoir for dispensing wine from the second reservoir through a wine dispense line connected to said reservoir, and for maintaining a nitrogen enriched atmosphere in contact with the wine in the second reservoir after a drink has been dispensed therefrom.

8. The improved wine dispenser defined in claim 7 in which the second control means valve is a solenoid controlled valve.

* * * * *